US012454804B2

(12) United States Patent
Dingman et al.

(10) Patent No.: US 12,454,804 B2
(45) Date of Patent: Oct. 28, 2025

(54) SUCTION PILE COFFERDAM

(71) Applicant: Delta SubSea LLC, Montgomery, TX (US)

(72) Inventors: Scott P. Dingman, Montgomery, TX (US); Perry Loughridge, Montgomery, TX (US)

(73) Assignee: Delta SubSea LLC, Montgomery, TX (US)

( * ) Notice: Subject to any disclaimer, the term of this patent is extended or adjusted under 35 U.S.C. 154(b) by 1042 days.

(21) Appl. No.: 17/490,719

(22) Filed: Sep. 30, 2021

(65) Prior Publication Data

US 2022/0056659 A1 Feb. 24, 2022

Related U.S. Application Data

(63) Continuation-in-part of application No. 17/191,128, filed on Mar. 3, 2021, now Pat. No. 11,473,263, which is a continuation of application No. 16/719,476, filed on Dec. 18, 2019, now Pat. No. 10,947,692.

(60) Provisional application No. 62/880,231, filed on Jul. 30, 2019.

(51) Int. Cl.
*E02D 29/00* (2006.01)
*E02D 29/09* (2006.01)

(52) U.S. Cl.
CPC ..... *E02D 29/06* (2013.01)

(58) Field of Classification Search
CPC ..... E02D 29/06
See application file for complete search history.

(56) References Cited

U.S. PATENT DOCUMENTS

| | | | | |
|---|---|---|---|---|
| 4,408,405 | A | 10/1983 | Williams | |
| 5,382,115 | A * | 1/1995 | Jones | F16L 55/18 405/226 |
| 5,595,459 | A * | 1/1997 | LoMonaco | E02D 17/02 405/133 |
| 7,661,905 | B2 * | 2/2010 | Alhayari | B63B 21/27 405/224.1 |
| 2019/0145072 | A1 | 5/2019 | Haigh | |

FOREIGN PATENT DOCUMENTS

KR 20100132192 A * 2/2010

* cited by examiner

*Primary Examiner* — Kyle Armstrong
(74) *Attorney, Agent, or Firm* — Jason P. Mueller; FisherBroyles, LLP

(57) ABSTRACT

A cofferdam is disclosed that includes an open frame structure having double walls defining a hollow space within each double wall, with each double wall having an open bottom end and a closed top end. Each of the double walls are configured to act as suction piles allowing liquid to be removed from the space within each double wall to thereby induce negative pressure when the cofferdam is installed in a sub-sea configuration. Each of the double walls may include a plurality of partitions respectively defining a plurality of suction piles, the suction piles fluidically coupled by a manifold that may allow liquid to be removed from the suction pile to thereby drive the cofferdam structure into the subsea surface due to the induced negative pressure. A further embodiment cofferdam structure includes an open frame structure and one or more suction piles attached to the open frame structure.

22 Claims, 9 Drawing Sheets

SUCTION PILE COFFERDAM

CROSS-REFERENCE TO RELATED APPLICATIONS

The present application is a continuation-in-part of U.S. patent application Ser. No. 17/191,128, filed Mar. 3, 2021, which is a continuation of U.S. patent application Ser. No. 16/719,476, filed Dec. 18, 2019, which issued as U.S. Pat. No. 10,947,692 on Mar. 16, 2021, which claims the benefit of U.S. Provisional Patent Application No. 62/880,231, filed Jul. 30, 2019, the entire contents of each of which are incorporated herein by reference.

BRIEF DESCRIPTION OF THE DRAWINGS

The accompanying drawings are part of this disclosure and are incorporated into the specification. The drawings illustrate example embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like, but not necessarily the same or identical, elements throughout.

DETAILED DESCRIPTION

This disclosure generally relates to cofferdams having suction pile anchors. A convention cofferdam is a watertight enclosure that may be pumped dry to permit construction work below a waterline, as when building a bridge or repairing a ship. Cofferdams may also be used in sub-sea applications when sediment is needed to be removed from a subsea location. Suction piles (also known as suction caissons) are fixed platform anchors that are used as anchors for offshore installations, oil platforms, oil drilling platforms, etc. A conventional suction pile is essentially a large cylinder that is closed at one end. The structure is lowered to the ocean floor, with a downwardly facing open end, where the structure partially sinks into ocean-floor sediment of its own weight. Water is then pumped out of the structure causing a negative pressure inside the structure. The negative pressure forces the suction pile into the seabed sediment whereby the suction pile becomes strongly attached to the ocean floor and serves as an anchor. Once installed, the suction pile resists axial and lateral loads and may be used to secure mooring lines that are attached to the suction pile at various load points. As described in greater detail below, suction piles may be attached to a cofferdam structure or the cofferdam structure may include internal structures that may be used as suction piles to secure the cofferdam structure.

Figure 1:
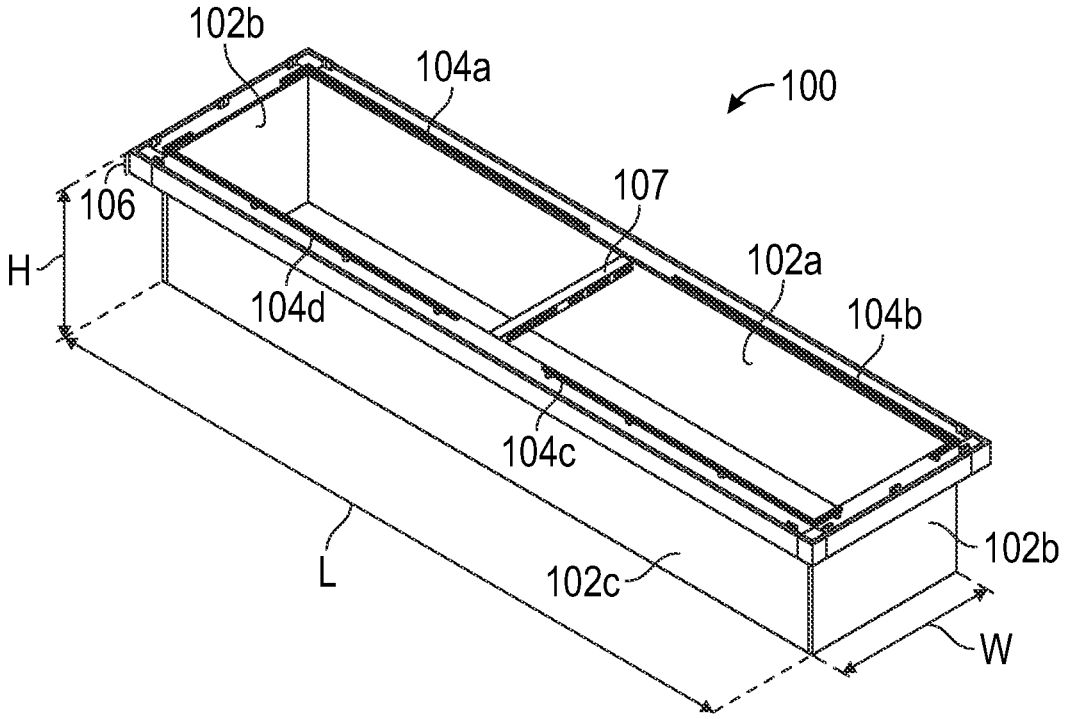
FIG. 1 is a three-dimensional perspective view of a cofferdam structure including suction piles, in accordance with one or more embodiments of the disclosure.

FIG. 1 is a three-dimensional perspective view of a cofferdam structure 100 including suction piles, in accordance with one or more embodiments of the disclosure. As described in greater detail below, cofferdam structure 100 includes double walls each having an open end at the bottom and a closed end at the top so that walls function as a suction pile. In this way, water may be partially or completely removed from the walls of cofferdam structure 100 so that induced negative pressure within the walls generates a net force that pushes cofferdam structure 100 into a sediment layer of the seabed. Cofferdam structure 100 may be used for deep sea operations when it is necessary to excavate sediment from an area of the sea floor for maintenance or installation of a subsea structure such as a drilling rig, an oil well, a pipeline, etc. Cofferdam structure 100 may also be used for undersea exploration, recovery of a shipwreck, recovery of sunken treasure, etc. In further embodiments, cofferdam structure 100 may be used for applications other than those requiring excavation from the sea floor. For example, cofferdam structure 100 may be used for oil/gas well decommissioning, well intervention, control and plugging of wells, abandoning wells, etc.

As illustrated in FIG. 1, cofferdam structure 100 includes four walls 102*a*, 102*b*, 102*c*, and 102*d* that form a rectangular open frame structure. Cofferdam structure 100 is characterized by a length L, a width W, and a height H. According to an embodiment, cofferdam structure 100 may have dimensions L=750 feet, W=150 feet, and H=120 to 150 feet. Walls 102*a* to 102*d* may be four-foot stud walls enclosing a hollow space in between, as described in greater detail below with reference to FIG. 4. Cofferdam structure 100 may further be configured to include an extended structure 106 (i.e., an overhang) around a top border region of cofferdam structure 100. In some embodiments, extended structure 106 may serve as a mud mat. Extended structure 106 may have height of from 20 to 50 feet and a width of approximately 20 feet. Other embodiments may have other dimensions for comparable features. Cofferdam structure 100 may further include a walkway 107 that may be used during maintenance or installation operations. Other embodiments may omit extended structure 106 and/or walkway 107.

As described in greater detail below, cofferdam structure 100 may include suction pile structures built into walls 102*a*, 102*b*, 102*c*, and 102*d*. As such, cofferdam structure 100 may be provided with suction pile equipment that is configured to allow removal of water from walls 102*a*, 102*b*, 102*c*, and 102*d*. As shown in FIG. 1, cofferdam structure 100 may include fluidic pipes or tubing 104*a* to 104*d* that may be configured to make a fluidic connection with internal spaces of walls 102*a* to 102*d*. Fluidic pipes or tubing 104*a* to 104*d* may further be connected by a manifold (not shown). An ROV may make one or more fluidic connections with fluidic pipes or tubing 104*a* to 104*d* through various pieces of suction pile equipment. In this way, an ROV may partially or completely pump water out of walls 102*a* to 102*d*. Use of an ROV, however, is only one method by which cofferdam structure 100 may be accessed, ballasted/de-ballasted, etc. In other embodiments, fluidic connections with fluidic pipes or tubing 104*a* to 104*d* of cofferdam structure 100 may be made using any suitable device such as a topside pump, a skid-mounted pump, a subsea pump, etc.

Figure 2:
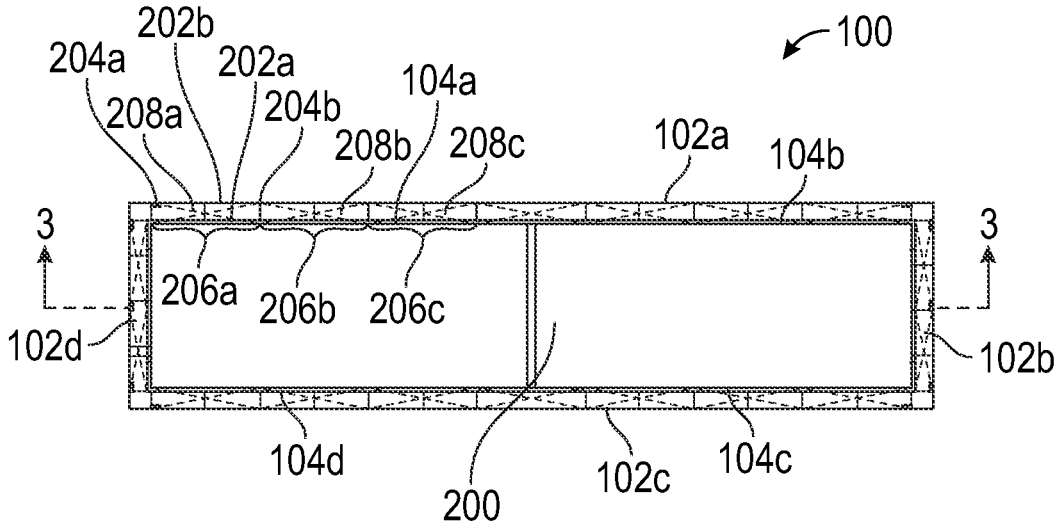
FIG. 2 is a top view of a cofferdam structure including suction piles, in accordance with one or more embodiments of the disclosure.

FIG. 2 is a top view of cofferdam structure 100 of FIG. 1, in accordance with one or more embodiments of the disclosure. Walls 102*a* to 102*d* enclose an open region 200. Once cofferdam structure 100 is installed on the seabed, sediment may be removed from region 200 as mentioned above. Each of walls 102*a* to 102*d* may be a double-walled structure having an inner wall 202*a* and an outer wall 202*b*. Further, the double-walled structure may be partitioned into a plurality of compartments by partition structures 204*a*, 204*b*, etc. In this way, each double-walled structure may be configured to include a plurality of hollow regions 206*a*, 206*b*, 206*c*, etc. Each of regions 206*a*, 206*b*, 206*c*, etc. may be provided with a closed top end structure 208*a*, 208*b*, 208*c*, etc., and a corresponding open bottom end structure (e.g., see open bottom 406 in FIG. 4). In this way, regions 206*a*, 206*b*, 206*c*, etc., may be configured to act as suction piles. Each of regions 206*a*, 206*b*, 206*c*, etc., may be fluidically coupled via fluidic pipes or tubing 104*a* to 104*d* so that water may be removed from regions 206*a*, 206*b*, 206*c*, etc., to thereby induce negative pressure within regions 206*a*, 206*b*, 206*c*, etc. Fluidic pipes or tubing 104*a* to 104*d* may further be connected by a manifold (not shown). FIG. 2 also defines a cross section 3-3 that is used to define the cross-sectional view of cofferdam structure 100 shown in FIG. 3, and described in greater detail below.

Figure 3:
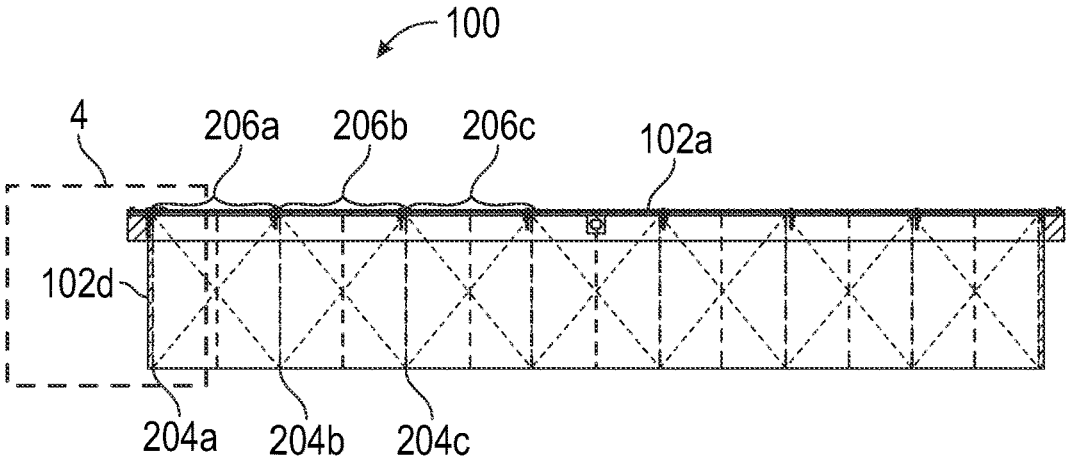
FIG. 3 is a cross-sectional view of a cofferdam structure including suction piles, in accordance with one or more embodiments of the disclosure.
Figure 4:
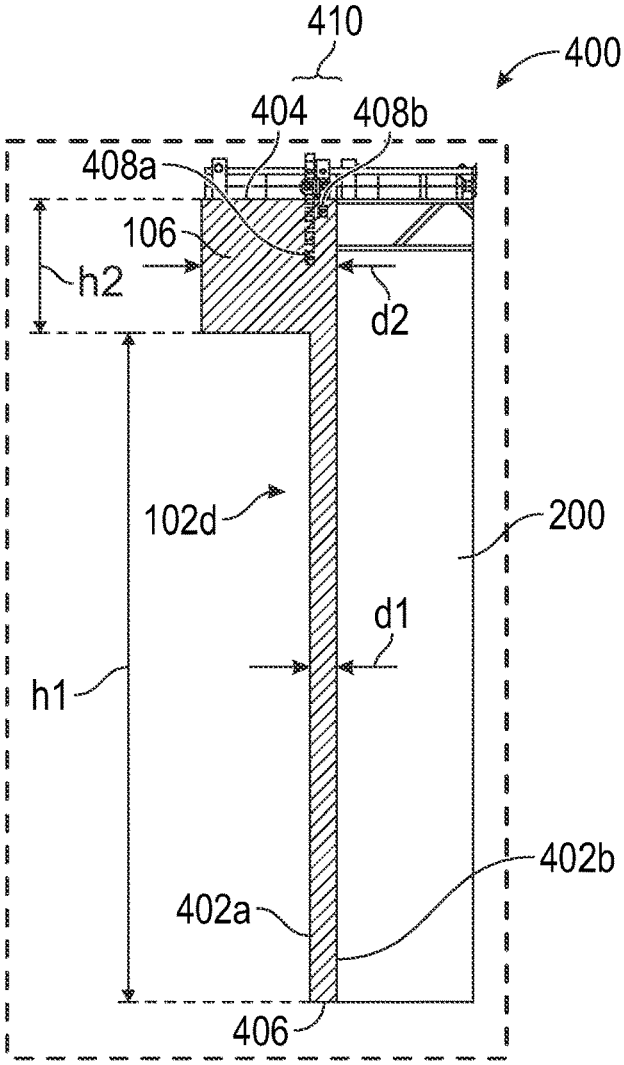
FIG. 4 is an enlarged cross-sectional view of an end wall of the cofferdam structure of FIG. 3, in accordance with one or more embodiments of the disclosure.

FIG. 3 is a cross-sectional view of cofferdam structure 100 including suction piles, in accordance with one or more embodiments of the disclosure. This cross-sectional view cuts through end wall 102*d* as shown in FIG. 4, and described in greater detail below. FIG. 3 also provides a side view of internal wall 102*a*. Although not shown in cross section, regions 206*a*, 206*b*, 206*c*, etc., of internal wall 102*a* are also indicated. Regions 206*a*, 206*b*, 206*c*, etc., are separated by internal partitions 204*a*, 204*b*, 204*c*, etc., to thereby form hollow spaces that may service as suction piles, as mentioned above and described in greater detail below.

FIG. 4 is an enlarged cross-sectional view 400 of end wall 102*d* of cofferdam structure 100 of FIG. 3, in accordance with one or more embodiments of the disclosure. End wall 102*d* includes an outer wall 402*a* and an inner wall 402*b* that forms a hollow space between walls 402*a* and 402*b*. Outer wall 402*a* is an externally facing wall and inner wall 402*b* faces internal region 200 (e.g., see FIG. 2). End wall 102*d* further includes a closed top 404 structure and an open bottom end 406. End wall 102*d* further includes extended structure 106, as described above. In this configuration, a suction pile is formed by a hollow region (e.g., shown as a hatched region) that includes a first hollow region of height h1 and second hollow region within extended structure 106 having height h2. The first hollow region may have thickness d1 and the second hollow region may have thickness d2. In an example embodiment, h1=100 feet, d1=4 feet, h2=20 feet, and d2=20 feet. Other embodiments may have other dimensions for comparable features.

The suction pile of FIG. 4 (i.e., hatched region of FIG. 4) may further be provided with one or more fluidic conduits. In this example, two fluidic conduits 408*a* and 408*b* are shown. Fluidic conduits 408 may have various configurations. For example, fluidic conduit 408*a* may have a first length that extends into extended structure 106 and fluidic conduit 408*b* may have a second length. In this example, the first length is longer than the second length. In other embodiments, both fluidic conduits 408*a* and 408*b* may have a common length. Other embodiments may have greater or fewer fluidic conduits. In this example, fluidic conduits 408*a* and 408*b* are shown as perforated pipes that are configured to allow water to flow through a plurality of apertures. Perforated pipes may be advantageous for use in water that contains mud and/or other sediment. In this regard, perforated pipes may be less prone to clogging due to mud and/or other sediment than pipes that are not perforated. Other embodiments may have fluidic conduits 408*a* and 408*b* having smooth surfaces with a single opening at a distal end of each fluidic conduit (not shown).

Fluidic conduits 408*a* and 408*b* may be fluidically coupled to suction pile equipment 410 that may allow an ROV or other external device to couple to fluidic conduits 408*a* and 408*b*. For example, a pump provided by an ROV may be configured to fluidically couple to fluidic conduits 408*a* and 408*b* and to pump water out of the suction pile structure. In other embodiments, fluidic connections with fluidic conduits 408*a* and 408*b* may be made using any suitable device such as a topside pump, a skid-mounted pump, a subsea pump, etc.

Figure 5:
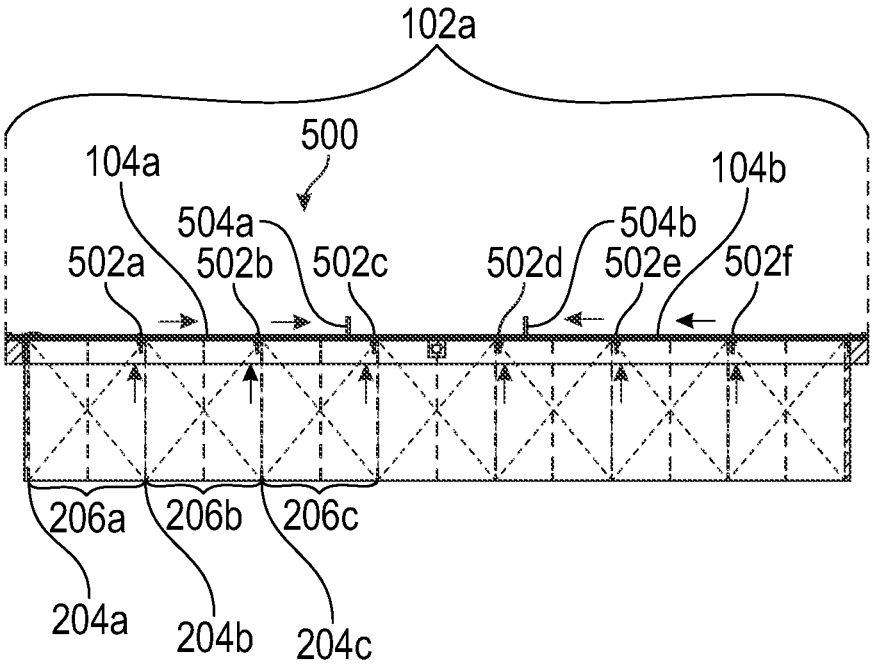
FIG. 5 is a cross-sectional view of a cofferdam structure including fluidic connections between a plurality of suction piles, in accordance with one or more embodiments of the disclosure.

FIG. 5 is a cross-sectional view 500 of a cofferdam structure including fluidic connections between a plurality of suction piles, in accordance with one or more embodiments of the disclosure. FIG. 5 shows a view similar to that of FIG. 3 that is defined by the cross section 3-3 of FIG. 2. As with FIG. 3, the view of FIG. 5 shows an internal surface of wall 102*a* and a cross section of wall 102*d*, as described above with reference to FIG. 3. As described above with reference to FIG. 2, wall 102*a* includes partitions 204*a*, 204*b*, 204*c*, etc., that divide wall 102*a* into a plurality of hollow regions 206*a*, 206*b*, 206*c*, etc. Each of regions 206*a*, 206*b*, 206*c*, etc., is configured as a suction pile similar to the suction pile structure (e.g., hatched region) of FIG. 4.

Regions 206*a*, 206*b*, 206*c*, etc., can be combined into a single section or can be made separately, deployed separately, installed separately, and sunk into the seabed separately as independent suction piles. Additionally, regions 206*a*, 206*b*, 206*c*, etc., can be connected together, including, for example, through tongue-and-groove attachment, dovetailing, mortise, mortise-and-tenon, hinged joint or other joining arrangements (e.g. see FIG. 10A through 10J). Further, optionally, regions 206*a*, 206*b*, 206*c*, etc., can be mechanically overlapped with other regions 206*a*, 206*b*, 206*c*, etc., e.g., for example, to form combined structures, including cofferdams. Further still, at least because regions 206*a*, 206*b*, 206*c*, etc., can be separate sections, different forces can be applied to individual regions 206*a*, 206*b*, 206*c*, etc., when configuring regions 206*a*, 206*b*, 206*c*, etc., as suction piles. Water or other fluid or matter can be sucked or otherwise removed from interiors of regions 206*a*, 206*b*, 206*c*, etc., including by sucking out sections by utilizing similar, even, or differing forces independently, evenly or unevenly. Any variation in the vacuum or sucking force between disparate regions 206*a*, 206*b*, 206*c*, etc., may be performed for a variety of reasons, including, for example, due to uneven seabed or differing seafloor characteristics. Further still, as each section is lowered to the seabed, the sections can be sunk independently and, optionally, the sections can overlap and can be placed close enough together to form a subsea cofferdam. Regions 206*a*, 206*b*, 206*c*, etc., may be lowered to the seafloor from a surface vehicle in sections or can be lowered together in a desired configuration.

In further embodiments, regions 206*a*, 206*b*, 206*c*, etc., may be formed by welding a plurality of rectangularly-shaped suction piles together to form wall 102*a*. As described above with reference to FIG. 4, each region 206*a*, 206*b*, 206*c*, etc., may be provided with one or more fluidic conduits. In this example, fluidic conduits 502*a* to 502*f* are shown. Each of fluidic conduits 502*a* to 502*f* provide a fluidic pathway through which water may be pumped out of the various suction pile structures formed by regions 206*a*, 206*b*, 206*c*, etc. Fluidic conduits 502*a* to 502*f* may be accessed individually by an ROV that provides separate fluidic connections to fluidic conduits 502*a* to 502*f*. In other embodiments, fluidic connections with fluidic conduits 502*a* to 502*f* may be made using any suitable device such as a topside pump, a skid-mounted pump, a subsea pump, etc.

Alternatively, one or more of the fluidic conduits 502*a* to 502*f* may be coupled together via one or more fluidic pipes or tubing 104*a* to 104*d*, as described above with reference to FIG. 1. Fluidic pipes or tubing 104*a* to 104*d* may further be connected by a manifold (not shown). For example, fluidic conduits 502*a* to 502*c* may be coupled via fluidic pipes or tubing 104*a*, while fluidic conduits 502*d* to 502*f* may be coupled via fluidic pipes or tubing 104*b*. Fluidic pipes or tubing 104*a* may be further coupled to fluidic port 504*a* and fluidic pipes or tubing 104*b* may be coupled to fluidic port 504*b*. Fluidic ports 504*a* and 504*b* may be configured to allow an ROV to make a fluidic connection with fluidic pipes or tubing 104*a* and 104*b*, respectively. In this way, an ROV may couple to the cofferdam structure of FIGS. 1 to 5 and to pump water from multiple suction pile structures simultaneously. In other embodiments, fluidic connections with fluidic ports 504*a* and 504*b* may be made using any suitable device such as a topside pump, a skid-mounted pump, a subsea pump, etc.

Figures 6A, 6B:
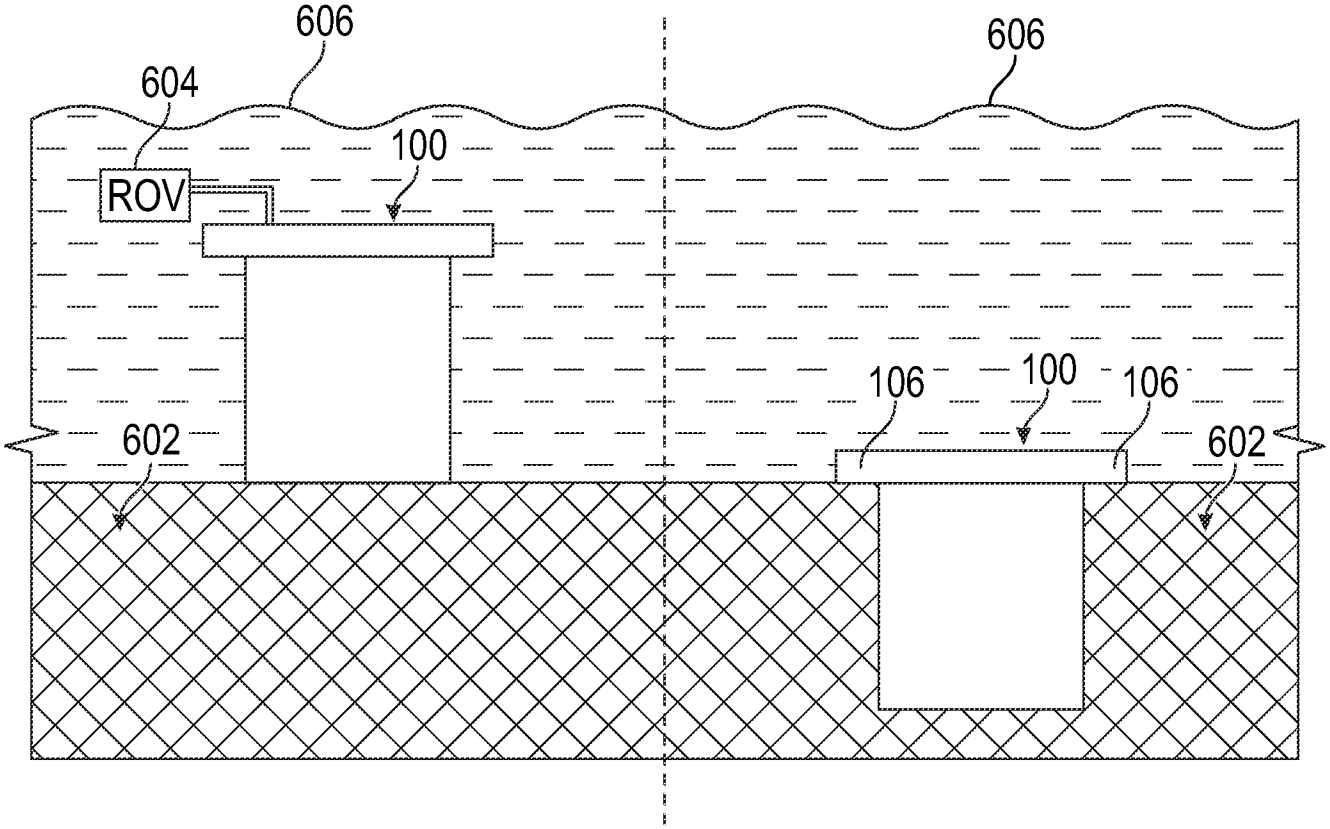
FIG. 6A illustrates an end view of a cofferdam structure including suction piles in a first configuration during installation, in accordance with one or more embodiments of the disclosure.
FIG. 6B illustrates an end view of a cofferdam structure including suction piles in a second configuration during installation, in accordance with one or more embodiments of the disclosure.

FIGS. 6A and 6B illustrate an end view of the cofferdam structure 100 of FIGS. 1 to 5 in first and second configurations during installation, in accordance with one or more embodiments of the disclosure. Cofferdam structure 100 may be installed using a process that starts with cofferdam structure 100 being lowered into the ocean. Fluidic structures (not shown in FIGS. 6A and 6B) may be opened while cofferdam structure 100 moves through water toward the ocean floor or to a subsea surface of mud or sediment 602. When cofferdam structure 100 comes to rest on a layer of mud or sediment 602 below a surface 606 of the ocean, water may be pumped out of cofferdam structure 100 by an ROV 604, as shown in FIG. 6A. In other embodiments, water may be pumped out of cofferdam structure 100 by any suitable device such as a topside pump, a skid-mounted pump, a subsea pump, etc. As described above, removal of water from cofferdam structure 100 induces negative pressure in the walls of cofferdam structure 100. After a certain amount of water is removed from the walls of cofferdam structure 100, fluidic ports (e.g., ports 504*a* and 504*b* of FIG. 5) may be closed to make a watertight connection to thereby maintain the negative pressure that develops in the walls of cofferdam structure 100.

Pressure of water above cofferdam structure 100 then forces cofferdam structure 100 into the layer of mud or sediment 602. As shown in FIG. 6B, cofferdam structure 100 may come to rest in a configuration in which extended structures 106 make contact with a surface of the mud or sediment 602 on the ocean floor. In this way, extended structures 106 may serve as a mud mat. Specific dimensions of cofferdam structure 100 may be chosen based on a particular application. For example, the height H (e.g., see FIG. 1 and related description) may be chosen based on a height of a particular thickness of mud or sediment 602 on the ocean floor, as described in greater detail below with reference to FIG. 7.

Figure 7:
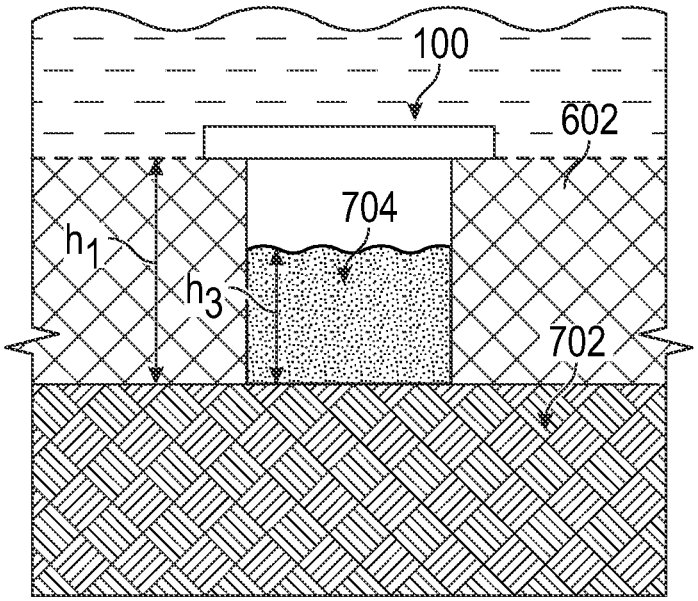
FIG. 7 illustrates an end view of a cofferdam structure including suction piles in which the height of the cofferdam structure is chosen based on a thickness of a sediment layer, in accordance with one or more embodiments of the disclosure.

FIG. 7 illustrates an end view of cofferdam structure 100 including suction piles in which a height h1 of the cofferdam structure is chosen based on a thickness of a mud or sediment layer 602, in accordance with one or more embodiments of the disclosure. As described above with reference to FIG. 4, in one embodiment, cofferdam structure 100 may have a height h1 that is approximately 100 feet. Such an embodiment may be advantageous for an application in which a sediment layer may have a thickness that is approximately 100 feet thick. The designation of height h1 being approximately 100 feet is merely an example and does not imply any limitation, and other embodiments may have other dimensions for comparable features. In this configuration, cofferdam structure 100 may be forced down through sediment layer 602 and may come to rest on a lower layer 702 that may have increased mechanical properties (e.g., layer 702 may be a sediment layer with an increased density or layer 702 may be bedrock).

The configuration of FIG. 7 allows mud or sediment 704 to be removed (i.e., excavated) from an internal space of cofferdam structure 100. In this example, mud or sediment 704 has been removed leaving a thickness h3 of mud or sediment 704. As described above, h1 may be approximately 100 feet. The thickness h3 of remaining mud or sediment 704 after excavation may be approximately 80 feet. These specific dimensions are merely an example and do not imply any limitation. Indeed, other embodiments may have other dimensions for comparable features. In order to maintain stability of cofferdam structure 100, it may be necessary to leave a thickness h3 of sediment within cofferdam structure 100 to maintain a seal that prevents material external to cofferdam structure 100 from entering cofferdam structure 100. If additional sediment 704 needs to be removed for a certain application, one or more additional smaller cofferdams may be installed, as described in further detail below with reference to FIG. 8.

Figure 8:
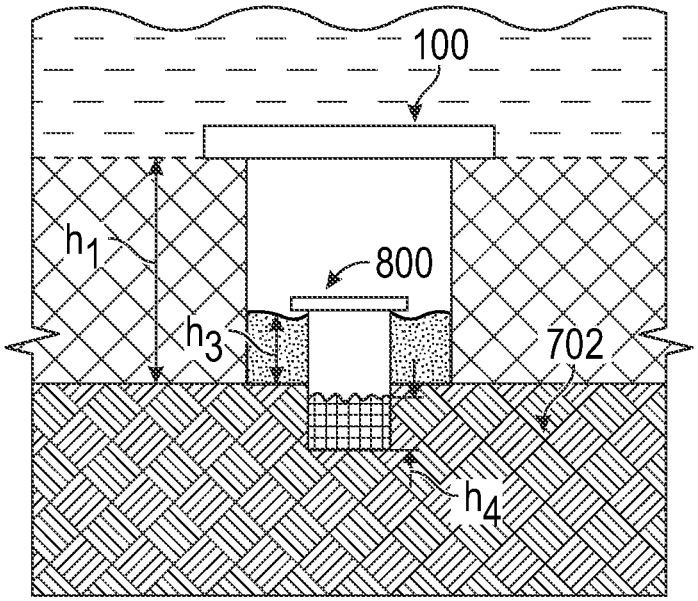
FIG. 8 illustrates a second cofferdam structure installed within a first cofferdam structure, in accordance with one or more embodiments of the disclosure.
Figure 8A:
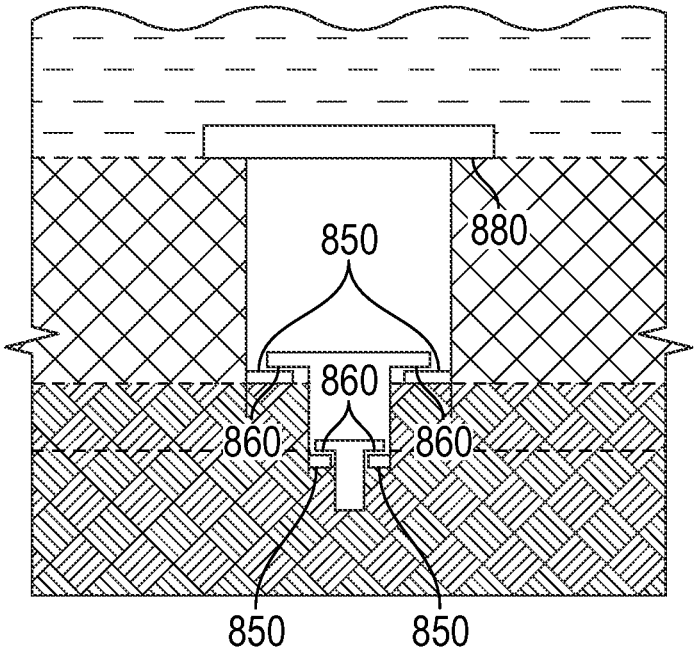
FIG. 8A illustrates a second cofferdam structure installed within a first cofferdam structure having stop surfaces that may secure the cofferdams together and allow the cofferdams to telescope into a sea floor, in accordance with one or more embodiments of the disclosure.

FIG. 8 illustrates a second cofferdam structure 800 within the first cofferdam structure 100, in accordance with one or more embodiments of the disclosure. This embodiment makes it possible to remove more sediment than was removed in the example above (i.e., described with reference to FIG. 7). In this regard, it may be necessary to leave at least a thickness h3 of sediment to maintain stability of cofferdam structure 100. For an operation requiring removal of additional sediment, a second cofferdam structure 800 having suction piles may be installed. As shown, this second cofferdam structure 800 may allow removal of an additional amount of sediment down to a thickness of h4. Further, the presence of second cofferdam structure 800 allows material to be removed down to a depth that is lower than the bottom of cofferdam structure 100, as shown. In this example, h4 may have a height that is in a range from approximately 0 to 80 feet. These specific dimensions are merely an example and do not imply any limitation. Indeed, other embodiments may have other dimensions for comparable features as needed for various applications. Third, fourth, fifth, etc cofferdams can be placed within each other, respectively, to further telescope deeper into the sea floor. In embodiments, a bottom area of a first cofferdam structure may have a lip or stop surface 850 located internally at a lower portion thereof. The lip or stop surface may have a top surface configured to interface with an outer flange or exterior stop surface or lip 860 of second cofferdam placed within the first cofferdam. The stop surfaces may secure the cofferdams together and allow the cofferdams to telescope deeper into the sea floor. See FIG. 8A. The first largest cofferdam that rests on the sea floor may have a larger exterior flange 880 having a surface area so as to prevent the structure from sinking into the sea floor. Each of the cofferdams may have various configurations and may be made of multiple sections installed individually or as a single unit. When installed in separate sections, the section may be attached or placed together to form the cofferdam using the various configuration described herein, e.g., see FIGS. 10A to J.

Figure 9:
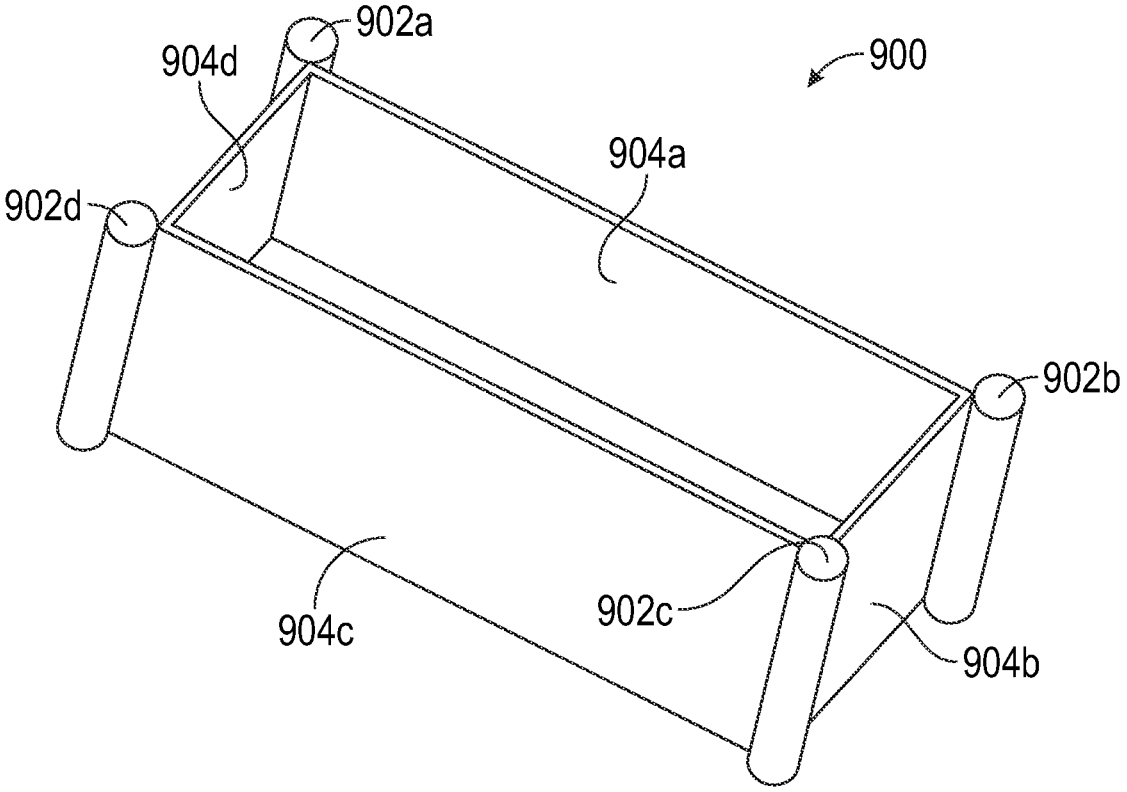
FIG. 9 is a three-dimensional perspective view of a cofferdam structure including suction piles, in accordance with one or more embodiments of the disclosure.

FIG. 9 is a three-dimensional perspective view of a further cofferdam structure 900 including suction piles, in accordance with one or more embodiments of the disclosure. In contrast to the cofferdam structure 100 of FIGS. 1 to 8, cofferdam structure 900 includes suction piles 902*a* to 902*d* attached to a frame structure that includes four walls 904*a* to 904*d*. In this regard, suction piles 902*a* to 902*d* and walls 904*a* to 904*d* may be steel structures that are fastened together. For example, walls 904*a* to 904*d* may be welded together to form a rectangular frame structure. In further embodiments, walls 904*a* to 904*d* may be attached to one another using various fasteners, such as bolts, rivets, etc. Further, suction piles 902*a* to 902*d* may be attached to walls 904*a* to 904*d* by welding or may be attached using various fasteners, such as bolts, rivets, etc. In other embodiments, suction piles 902*a* to 902*d* and walls 904*a* to 904*d* may be made of any other suitable structural material.

FIG. 9 illustrates an embodiment in which suction piles 902*a* to 902*d* are attached to corners of a rectangular frame structure that includes walls 904*a* to 904*d*. Further embodiments may include many different configurations of walls and suction piles. For example, the frame structure need not be a rectangular structure as shown in FIG. 9, but rather, may be a circle, an oval, a square, a triangle, a pentagon, a hexagon, or other multi-sided polygon. In additional embodiments, the frame structure may take any shape (e.g., a shape of a ship) as needed for a particular application. Further embodiments may include greater or fewer suction piles. For example, although FIG. 9 is shown with four circular suction piles 902*a* to 902*d*, other embodiments may have one, two, three, five, six, etc., suction piles. Further, suction piles need not have a cylindrical shape as shown in FIG. 9. In other embodiments, suction piles may have a rectangular shape, a square shape, a triangular shape, a pentagonal shape, a hexagonal shape, or may be another multi-sided polygon. Further, suction piles need not be attached to external surfaces of the rectangular frame structure of FIG. 9 but may be attached on internal surfaces, may be attached on a mixture of internal and external surfaces, or may be configured to be part of internal structures of cofferdam structure 900, as was the case with the embodiments described above with reference to FIGS. 1 to 8.

The cofferdam shown in FIG. 9 can be made in separate piece that attach together. For example Suction piles 902*a* to 902*d* can be attached to walls 904*a* to 904*d*, respectively, as four separate pieces. Each of these pieces can be made separately, deployed separately, installed separately, and sunk into the seabed separately as independent suction piles. Each of these pieces can be connected together, including, for example, through tongue-and-groove attachment, dovetailing, mortise, mortise-and-tenon, or other means of joining (see, for example, FIGS. 10*a* through 10J). Water or other fluid or matter can be sucked or otherwise removed from interiors of suction piles 902*a* to 902*d*, etc., including by sucking out sections by utilizing similar, even, or differing forces independently, evenly or unevenly. Any variation in the vacuum or sucking force between disparate suction piles 902*a* to 902*d*, etc., can be performed for a variety of reasons, including, for example, due to uneven seabed or differing seafloor characteristics. As each piece or section is lowered to the seabed, the sections can be sunk independently and, optionally, the sections can overlap and can be placed close enough together to form a cofferdam. Each piece or section may be lowered to the seafloor from a surface vehicle in sections or can be lowered together in a desired configuration.

Figure 10A:
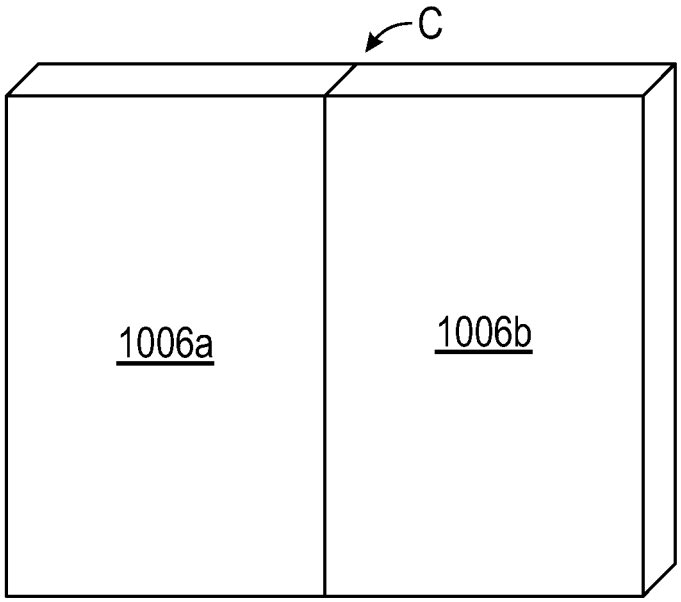
FIG. 10A through 10J show various interfaces between adjacent regions or suction piles.
Figure 10B:
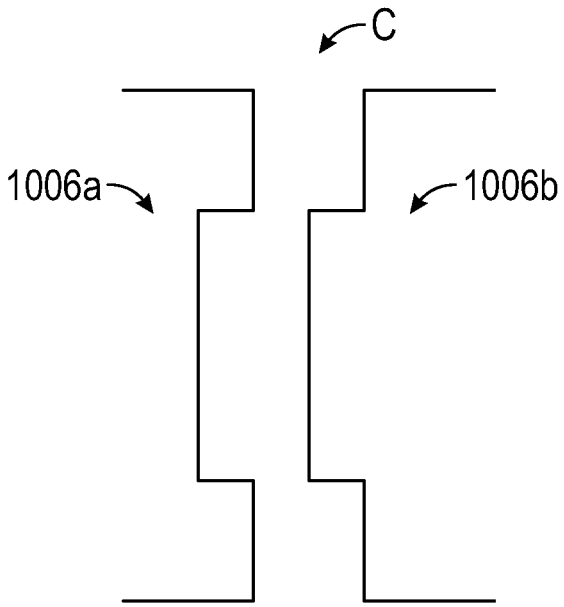
Figure 10C:
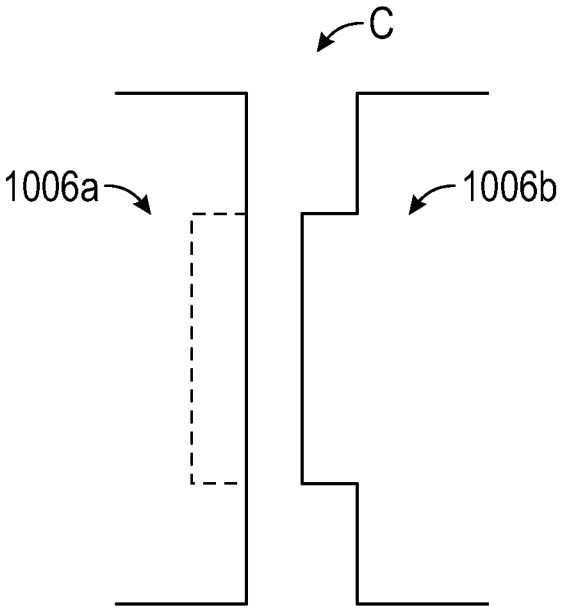
Figure 10D:
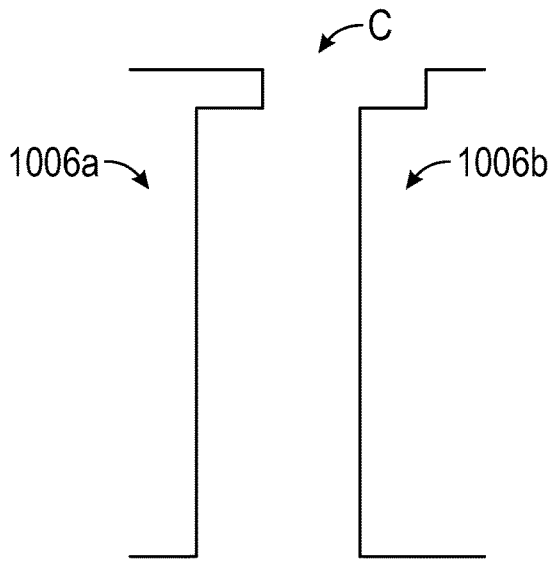
Figure 10E:
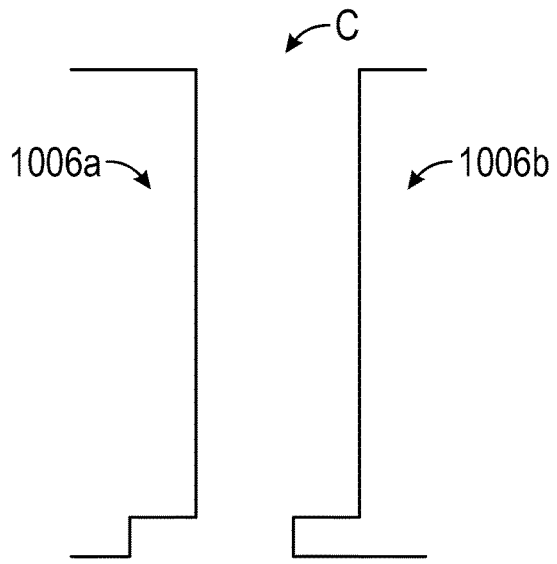
Figure 10F:
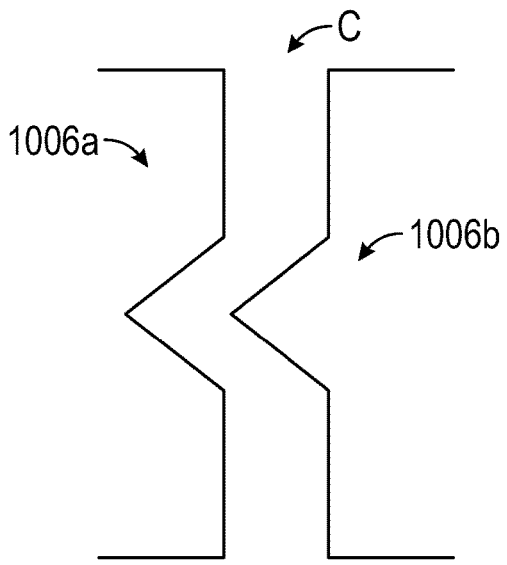
Figure 10G:
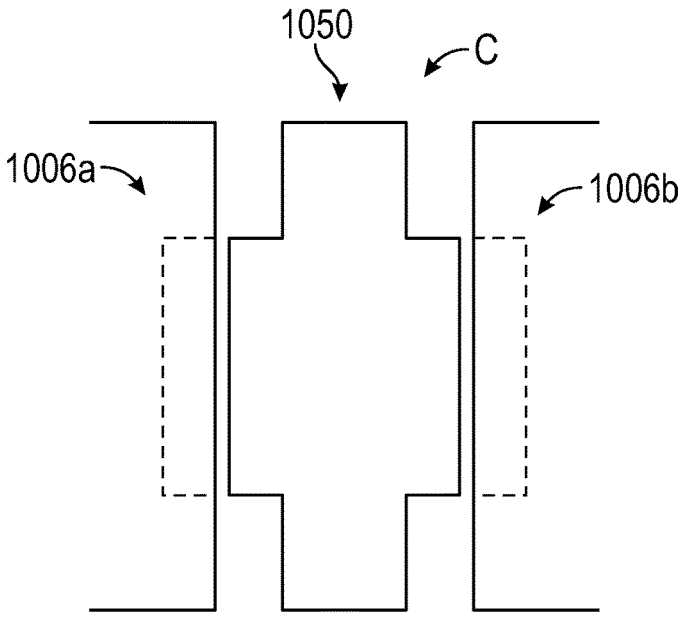
Figure 10H:
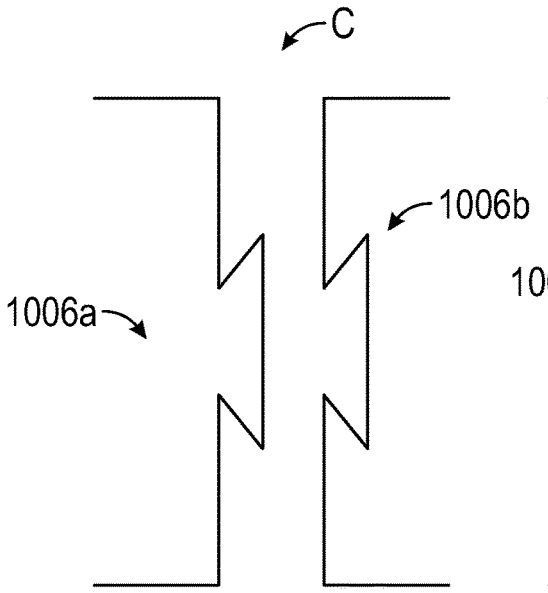
Figure 10I:
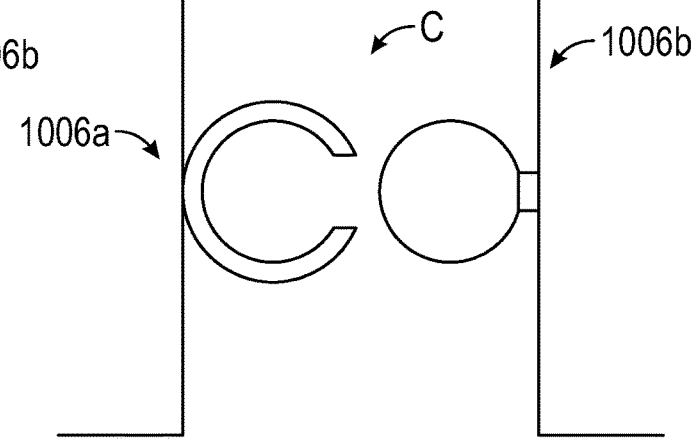
Figure 10J:
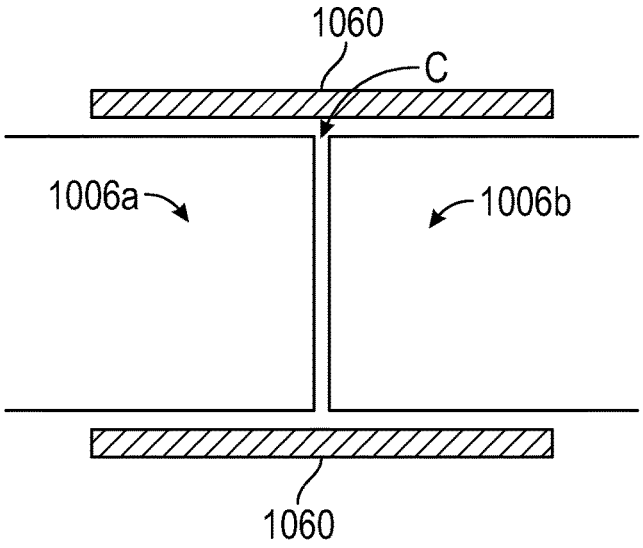

FIG. 10A shows an enlarged view of a connection C between adjacently placed region/suction pile 1006*a* and region/suction pile 1006*b*. Each of region/suction pile 1006*a* and 1006*b* are similar to regions 206*a*, 206*b*, 206*c*, etc. and suction piles 902*a*, 902*b*, 902*c*, 902*d*, etc. Each of region/suction pile 1006*a* and 1006*b* are separate structures that can be made separately, deployed separately, installed separately, and sunk into the seabed separately as independent regions or suction piles. Any additional number of regions or suction piles, similar to or different in configuration from, region/suction pile 1006*a* and 1006*b* can similarly be made separately, deployed separately, installed separately, and sunk into the seabed separately as independent regions or suction piles, with any additional number of regions or suction piles deployable to create arrays, patterns, cofferdams, structures, supports, etc. Further, although shown in an exemplary rectangular prism shape in FIG. 10A, the regions or suction piles can be formed in any shape desired, including cylindrical, triangular, multi-sided, concentric, etc. Additionally, the entire cofferdam structure can be configured in various shapes by piecing together different sections. In an embodiment, each section may have a suction pile portion and an extension thereof, for example a plate, that forms and extended wall of the cofferdam and secures to another section. Regions or suction piles 1006*a*, 1006*b*, etc., are able to be connected together or placed together, including, for example, through tongue-and-groove attachment, dovetailing, mortise, mortise-and-tenon, hinged, or other systems and structures of joining. Some exemplary connections of regions or suction piles 1006*a* and 1006*b* are shown in FIGS. 10B, 10C, 10D, 10E, 10F, 10H and 10I, with exemplary connections including overlapping outer edges, connecting interior features, disposing portions of one region/suction piles within a portion of an adjacent region/suction pile and a hinged connection. Hinged connection may provide for deployment and positions of sections with respect to each other. Further, individual or multiple regions or suction piles can be mechanically overlapped with other regions or suction piles. Additionally, in some exemplary embodiments, as shown in FIG. 10G, a spacer or reinforcing section 1050 can be provided between regions or suction piles, such as between region/suction pile 1006*a* and 1006*b*, with spacer 1050 providing an attachment means and/or reinforcing brace to secure 1006*a* and 1006*b* together. Spacers may be configured as elongated sections forming walls and may be secured to a suction pile section before deployment or after. Although not shown, in other exemplary embodiments, multiple spacers or combinations of spacers can be utilized. Additionally, as shown in FIG. 10J, plates 1060 may be used to position suction piles 1006*a*, 1006*b*, etc. in a desired location and secure the suction pile sections together to form a cofferdam or subsea structure. Further, an adhesive or additional securing means can be utilized between regions or suction piles 1006*a* and 1006*b*, between spacer 1050 and region/suction pile 1006*a*, and/or between spacer 1050 and region/suction pile 1006*b*.

Even further, either region/suction pile 1006*a*, region/suction pile 1006*b*, spacer 1050, plates 1060 or any combination of these can provide a means to secure final or intermediary positioning of regions or suction piles 1006*a* and 1006*b*. For example, as described in additional detail hereinbelow, in one exemplary embodiment, region/suction pile 1006*a* can be disposed lower/deeper into a subsea surface than adjacently placed region/suction pile 1006*b*. The deeper positioning of region/suction pile 1006*a* could be due to, for example, uneven seabed or differing seafloor characteristics. After region/suction pile 1006*a* and region/suction pile 1006*b* are positioned as desired, if connection C included an intentional or unintentional gap, a securing means, such as an adhesive or reinforcing injection, for example, could be inserted between regions or suction piles 1006*a* and 1006*b*. Optionally, if a spacer 1050 were utilized therebetween, an adhesive or reinforcing injection could be inserted between spacer 1050 and region/suction pile 1006*a*, and/or between spacer 1050 and region/suction pile 1006*b*. Such adhesive or reinforcing injection comprising a securing means that provides additional strength to the connections between regions or suction piles 1006*a* and 1006*b*, between spacer 1050 and region/suction pile 1006*a*, and/or between spacer 1050 and region/suction pile 1006*b*. These reinforced connected regions/suction piles would allow the connected regions/suction piles to function as a unit, and, for example, form part of a cofferdam, provide a support section, or otherwise function as a combination of previously separate regions or suction piles.

Further still, at least because region/suction pile 1006*a* and region/suction pile 1006*b* are separate structures, different forces can be applied to region/suction pile 1006*a* and region/suction pile 1006*b* when configuring region/suction pile 1006*a* and region/suction pile 1006*b* as suction piles. Water or other fluid or matter can be sucked or otherwise removed from interiors of region/suction pile 1006*a* and region/suction pile 1006*b*, with an even amount of force, with similar but unequal force, or differing forces independently, evenly or unevenly. Any variation in the vacuum or sucking force between region/suction pile 1006*a* and region/suction pile 1006*b* can be for a variety of reasons, including, for example, due to uneven seabed or differing seafloor characteristics. As each of region/suction pile 1006*a* and region/suction pile 1006*b* is lowered to the seabed, region/suction pile 1006*a* and region/suction pile 1006*b* can be sunk independently or can be sunk together. Additionally, region/suction pile 1006*a* and region/suction pile 1006*b* can be connected before being lowered to the subsea floor. In at least one exemplary embodiment, region/suction pile 1006*a* and region/suction pile 1006*b* can be secured together or overlap, and can be placed close enough together to form a cofferdam or subsea containment structure. If desired, generally before sinking region/suction pile 1006*a* and region/suction pile 1006*b* into the seabed, region/suction pile 1006*a* and region/suction pile 1006*b* can be repositioned to a desired location. Once in the desired location, region/suction pile 1006*a* and region/suction pile 1006*b* are typically sunk into the seabed by creating negative pressure or vacuum in an interior of region/suction pile 1006*a* or region/suction pile 1006*b* as described herein.

Conditional language, such as, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The specification and annexed drawings disclose examples of cofferdams having suction piles. The examples illustrate various features of the disclosure, but those of ordinary skill in the art may recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not limiting. Although specific terms are employed herein, they are used in a generic and descriptive sense only, and not used for purposes of limitation.

What is claimed is:

1. A subsea apparatus, comprising:

a cofferdam having multiple sections, wherein each section includes walls defining an interior, an exterior, an open bottom end, and a closed top end, one or more fluid conduits extending into the interior, and a fluid port configured to allow removal of fluid through the fluid conduit in an open configuration and maintain a negative pressure within the interior in a closed configuration, wherein each section is configured to be driven into a sea floor by an induced pressure differential between the interior and the exterior when a fluid is removed from the interior, via the one or more fluidic conduits, to generate a vacuum that induces a negative pressure within the interior, wherein the fluid port is closed to maintain the negative pressure within the interior to generate a force on the closed top end of the section that pushes the section into the sea floor.

2. The subsea apparatus of claim 1 wherein sections are connected together in the sea floor.

3. A subsea cofferdam comprising:

a plurality of open frame structures comprising at least a first open frame structure and a second open frame structure;

each of the first open frame structure and the second open frame structure comprising walls defining an interior, an open bottom end, and a closed top end, one or more fluid conduits extending into the interior, and a fluid port configured to allow removal of fluid through the fluid conduit in an open configuration and maintain a negative pressure within the interior in a closed configuration, wherein each of the first open frame structure and the second open frame structure are configured to be driven into a sea floor by allowing fluid to be removed from the interior of each of the first open frame structure and the second open frame structure, via the one or more fluidic conduits, to thereby generate a vacuum that induces a negative pressure within the first open frame structure and the second open frame structure, wherein each fluid port is closed to maintain the negative pressure within the interiors for the first open frame structure and the second open frame structure to generate forces on the closed top end of the open frame structures that pushed the open frame structures in the sea floor when the open frame structures are installed in a sub-sea configuration.

4. The cofferdam of claim 3 wherein the first open frame structure and the second open frame structure are configured to be installed independently of each other.

5. The cofferdam of claim 3 wherein the first open frame structure is configured to be connected to the second open frame structure.

6. The cofferdam of claim 5 wherein the first open frame structure is configured to be connected to the second open frame structure via at least one of a tongue-and-groove attachment, dovetailing, mortise, a hinge, or a mortise-and-tenon joint.

7. The cofferdam of claim 3 wherein at least a portion of the first open frame structure is configured to overlap at least a portion of the second open frame structure.

8. The cofferdam of claim 7 wherein the first open frame structure is configured to be mechanically overlapped to the second open frame structure.

9. The cofferdam of claim 3 wherein material is removed from the interior of the first open frame structure at a first rate to create the vacuum.

10. The cofferdam of claim 9 wherein material is removed from the interior of the second open frame structure at a second rate to create the negative pressure.

11. The cofferdam of claim 10 wherein the first rate is equal to the second rate.

12. The cofferdam of claim 10 wherein the first rate differs from and the second rate by at least a threshold amount.

13. The cofferdam of claim 12 wherein the first open frame structure is lowered deeper into a subsea surface than the second open frame structure.

14. The cofferdam of claim 3 wherein:

the plurality of open frame structures further comprises a third open frame structure; and the first open frame structure and the second open frame structure are lowered into the sub-sea configuration independent of the third open frame structure.

15. The cofferdam of claim 14 wherein the plurality of open frame structures are connected together.

16. The cofferdam of claim 3 further comprising a fluidic pipe connected by a manifold that provides a fluidic connection between at least two fluidic conduits.

17. The cofferdam of claim 16 further comprising at least one additional fluidic port-configured to allow an external device to make a fluidic connection with the fluidic pipe to allow the external device to pump liquid out of the interior of the first open frame structure.

18. The cofferdam of claim 16 wherein the fluidic pipe comprising at least one perforated pipe, the perforated pipe comprising a plurality of apertures.

19. The cofferdam of claim 18 wherein the fluidic conduits comprise at least two perforated pipes of unequal length.

20. A method of installing a cofferdam, the method including:

lowering the cofferdam to a subsea surface, wherein the cofferdam comprises:

an open frame structure having walls defining an interior, an open bottom end, and a closed top end, one or more fluid conduits extending into the interior, and a fluid port configured to allow removal of fluid through the fluid conduit in an open configuration and maintain a negative pressure within the interior in a closed configuration;

removing liquid from the interior of the walls via the fluidic conduit while the fluid port is in the open configuration to develop a vacuum that induces a negative pressure within the walls;

moving the fluid port to the closed configuration to maintain the negative pressure within the walls; and driving the cofferdam into the subsea surface due to the negative pressure maintained within the walls that generates a force on the closed top end the open frame structure that pushes the open frame structure in the subsea surface.

21. The method of claim 20, wherein removing liquid from the walls further comprises:

making a fluidic connection between an external device and a fluidic port of the cofferdam; and pumping liquid out of the walls using a pump provided by the external device.

22. The method of claim 20 further comprising:

installing a second cofferdam within the cofferdam by performing the steps of:

lowering the second cofferdam to a subsea surface within the cofferdam, wherein the second cofferdam comprises:

a second open frame structure having walls defining an interior, an open bottom end, and a closed top end;

removing liquid from the interior of the second open frame structure to thereby develop a vacuum that induces a negative pressure within the interior of the second open frame structure; and driving the second cofferdam into the subsea surface due to the negative pressure.

* * * * *